US011180310B2

(12) United States Patent
Siitonen et al.

(10) Patent No.: US 11,180,310 B2
(45) Date of Patent: Nov. 23, 2021

(54) ACTIVE MOISTURE CONTROL MATERIAL FOR PACKAGING

(71) Applicant: Stora Enso OYJ, Helsinki (FI)

(72) Inventors: Simo Siitonen, Rautjarvi (FI); Kimmo Nevalainen, Kotka (FI)

(73) Assignee: Stora Enso OYJ, Helsinki (FI)

( * ) Notice: Subject to any disclaimer, the term of this patent is extended or adjusted under 35 U.S.C. 154(b) by 380 days.

(21) Appl. No.: 15/774,231

(22) PCT Filed: Nov. 8, 2016

(86) PCT No.: PCT/IB2016/056706
§ 371 (c)(1),
(2) Date: May 7, 2018

(87) PCT Pub. No.: WO2017/081600
PCT Pub. Date: May 18, 2017

(65) Prior Publication Data

US 2018/0327973 A1 Nov. 15, 2018

(30) Foreign Application Priority Data

Nov. 9, 2015 (SE) ..... 1551447-4

(51) Int. Cl.

| | |
|---|---|
| ***D21H 27/30*** | (2006.01) |
| ***D21H 17/66*** | (2006.01) |
| ***D21H 27/10*** | (2006.01) |
| ***D21H 11/18*** | (2006.01) |
| ***D21H 17/68*** | (2006.01) |
| ***D21H 21/52*** | (2006.01) |
| ***D21H 17/22*** | (2006.01) |
| ***D21H 17/24*** | (2006.01) |
| ***D21H 17/33*** | (2006.01) |
| ***D21H 17/67*** | (2006.01) |
| ***D21H 21/22*** | (2006.01) |
| ***B65D 85/10*** | (2006.01) |
| ***B65D 81/24*** | (2006.01) |
| ***B65D 81/18*** | (2006.01) |
| ***B65D 81/26*** | (2006.01) |
| ***D21J 1/00*** | (2006.01) |

(52) U.S. Cl.
CPC ..... *B65D 85/1045* (2013.01); *B65D 81/18* (2013.01); *B65D 81/24* (2013.01); *B65D 81/264* (2013.01); *B65D 85/10* (2013.01); *D21H 11/18* (2013.01); *D21H 17/22* (2013.01); *D21H 17/24* (2013.01); *D21H 17/33* (2013.01); *D21H 17/66* (2013.01); *D21H 17/675* (2013.01); *D21H 17/68* (2013.01); *D21H 21/22* (2013.01); *D21H 21/52* (2013.01); *D21H 27/10* (2013.01); *D21H 27/30* (2013.01); *D21J 1/00* (2013.01)

(58) Field of Classification Search
CPC ..... D21H 11/18; D21H 17/66; D21H 21/16; D21H 27/10; D21H 17/675; D21H 21/52; D21H 27/30; D21H 17/68; D21H 21/22; D21H 17/22; D21H 17/24; D21H 17/33; D21H 17/74; B65D 81/24; B65D 85/10; B65D 81/18; B65D 81/264; B65D 85/1045; D21J 1/00; B32B 29/00
See application file for complete search history.

(56) References Cited

U.S. PATENT DOCUMENTS

| | | | | |
|---|---|---|---|---|
| 3,839,226 | A * | 10/1974 | Yates | C01B 33/325 502/407 |
| 4,934,524 | A | 6/1990 | St. Charles | |
| 4,977,031 | A | 12/1990 | Temple | |
| 5,247,068 | A * | 9/1993 | Donachy | C08G 69/10 502/402 |
| 5,427,235 | A | 6/1995 | Powell et al. | |
| 5,961,708 | A * | 10/1999 | Zetter | D21H 21/16 106/209.1 |
| 5,997,690 | A * | 12/1999 | Woodrum | A61L 15/60 162/100 |
| 7,198,841 | B2 * | 4/2007 | Nissinen | B82Y 30/00 428/330 |
| 8,034,740 | B2 * | 10/2011 | Kitahata | A61L 26/0019 502/407 |
| 8,678,543 | B2 * | 3/2014 | Zhou | B41M 5/5218 347/20 |
| 8,846,138 | B2 * | 9/2014 | Zhou | B41M 5/5218 427/158 |
| 2002/0060013 | A1 * | 5/2002 | Annergren | D21H 21/22 162/168.1 |
| 2003/0054167 | A1 * | 3/2003 | Wang | C08B 3/10 428/364 |
| 2003/0167789 | A1 * | 9/2003 | Tanimoto | F16L 59/065 62/457.7 |
| 2006/0153984 | A1 * | 7/2006 | Suzuki | A61F 13/5323 427/230 |
| 2007/0166438 | A1 * | 7/2007 | Kitahata | A61L 26/0019 426/242 |
| 2008/0190576 | A1 | 8/2008 | Champ et al. | |
| 2009/0321028 | A1 | 12/2009 | Kazuchiyo et al. | |

(Continued)

FOREIGN PATENT DOCUMENTS

| | | | |
|---|---|---|---|
| CN | 101890277 | A | 11/2010 |
| DE | 2253268 | A1 | 5/1974 |

(Continued)

OTHER PUBLICATIONS

Machine Translation of JP-2002004193-A. (Year: 2002).*

(Continued)

*Primary Examiner* — Jose A Fortuna
(74) *Attorney, Agent, or Firm* — Greer, Burns & Crain, Ltd.

(57) ABSTRACT

An active moisture control material comprising a fiber based material and at least one active additive, wherein said active additive is adapted to control moisture transfer in the active moisture control material, and wherein said moisture control material is produced in a paper or board making process, wherein the active additive is incorporated into said active moisture control material.

14 Claims, 1 Drawing Sheet

(56) References Cited

U.S. PATENT DOCUMENTS

| | | | | |
|---|---|---|---|---|
| 2010/0173080 | A1* | 7/2010 | Suzuki | A61F 13/15658 427/288 |
| 2010/0316846 | A1* | 12/2010 | DeJong | B32B 27/306 428/172 |
| 2010/0319864 | A1* | 12/2010 | Bhat | B32B 29/005 162/109 |
| 2011/0168771 | A1* | 7/2011 | Yan | B65D 3/22 229/404 |
| 2011/0205287 | A1* | 8/2011 | Zhou | D21H 21/16 347/20 |
| 2011/0210164 | A1* | 9/2011 | Babinsky | B32B 29/04 229/403 |
| 2011/0220532 | A1* | 9/2011 | Shah | B32B 27/08 206/524.2 |
| 2012/0012578 | A1* | 1/2012 | Hach | B32B 3/266 219/730 |
| 2012/0119140 | A1* | 5/2012 | Ito | A01K 1/0155 252/194 |
| 2012/0291972 | A1* | 11/2012 | Propst, Jr. | D21H 21/16 162/164.7 |
| 2012/0301641 | A1* | 11/2012 | Zhou | D21H 21/00 428/32.21 |
| 2012/0328689 | A1* | 12/2012 | Flynn | D21H 21/14 424/443 |
| 2013/0180120 | A1 | 7/2013 | Schmidt et al. | |
| 2013/0292279 | A1* | 11/2013 | Bengtsson | D21H 17/68 206/245 |
| 2014/0041818 | A1* | 2/2014 | Sealey | D21H 11/18 162/13 |
| 2014/0116005 | A1* | 5/2014 | Shah | B32B 1/02 53/401 |
| 2015/0167249 | A1* | 6/2015 | Ono | B32B 37/24 162/130 |
| 2015/0315747 | A1* | 11/2015 | Heiskanen | A47L 13/16 162/181.2 |
| 2016/0177512 | A1* | 6/2016 | Kawahara | D21H 21/52 435/289.1 |
| 2018/0327973 | A1* | 11/2018 | Siitonen | D21H 17/24 |
| 2019/0017225 | A1* | 1/2019 | Palumbo | B01J 20/327 |
| 2020/0063372 | A1* | 2/2020 | Everett | D21H 27/007 |
| 2020/0095039 | A1* | 3/2020 | Siitonen | D21H 17/74 |

FOREIGN PATENT DOCUMENTS

| | | | | | |
|---|---|---|---|---|---|
| EP | 0437816 | A1 | * | 7/1991 | D21H 17/43 |
| EP | 0580702 | B1 | * | 5/1998 | C08G 69/10 |
| GB | 1579832 | | | 11/1980 | |
| JP | 09067790 | A | * | 3/1997 | |
| JP | 3176539 | B2 | * | 6/2001 | D21H 17/66 |
| JP | 2002004193 | A | | 1/2002 | |
| JP | 2003239199 | A | | 8/2003 | |
| JP | 2005048318 | A | | 2/2005 | |
| JP | 2010013753 | A | | 1/2010 | |
| RU | 2348452 | C2 | | 3/2009 | |
| RU | 2466919 | C2 | | 11/2012 | |
| WO | WO-9217525 | A1 | * | 10/1992 | C08G 69/10 |
| WO | WO-9949905 | A2 | * | 10/1999 | D21H 23/14 |
| WO | WO-2010030795 | A2 | * | 3/2010 | A62C 99/0045 |
| WO | WO-2017081600 | A1 | * | 5/2017 | D21H 17/66 |

OTHER PUBLICATIONS

Machine Translation of JP-2003239199-A. (Year: 2003).*

Chinese Office Action, Application No. 201680065505.3, dated May 22, 2020.

International Search Report for PCT/IB2016/056706, dated Feb. 20, 2017.

* cited by examiner

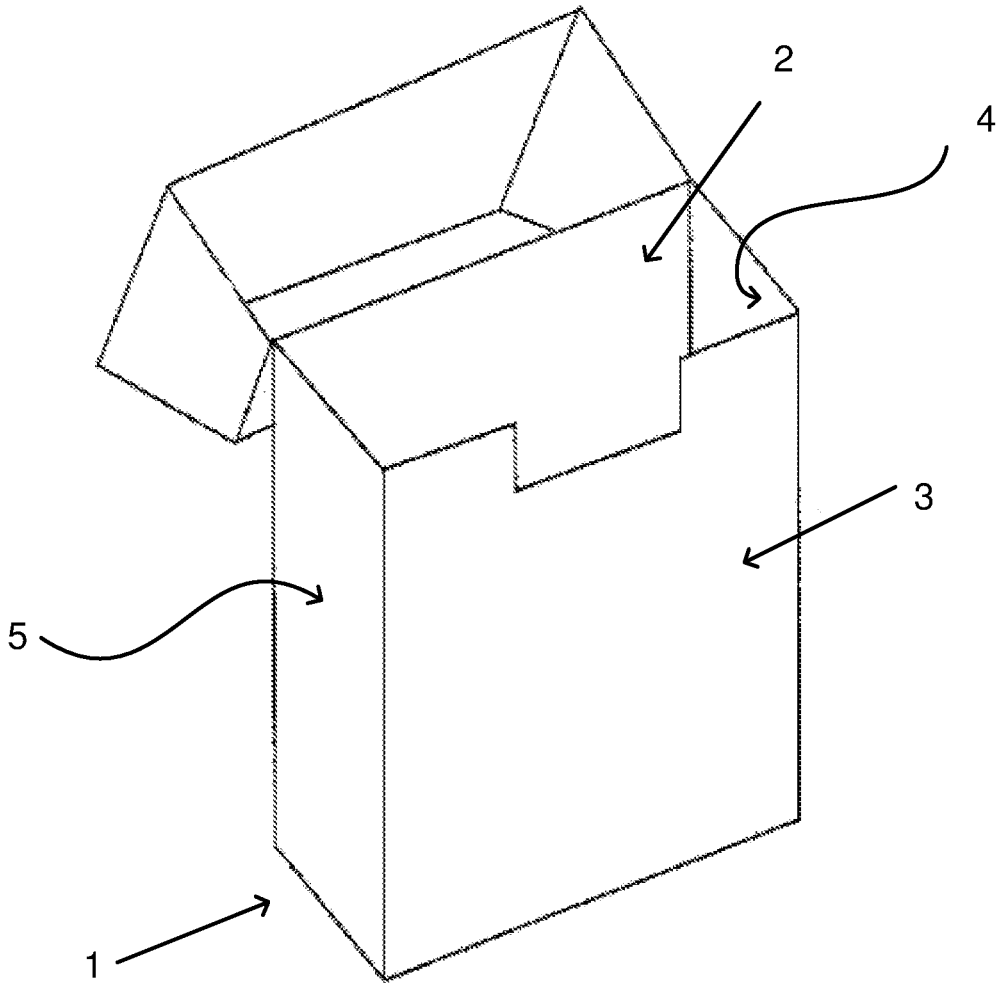
2
4
3
5
1

ACTIVE MOISTURE CONTROL MATERIAL FOR PACKAGING

This application is a U.S. National Phase under 35 U.S.C. § 371 of International Application No. PCT/IB2016/056706, filed Nov. 8, 2016, which claims priority under 35 U.S.C. §§ 119 and 365 to Swedish Application No. 1551447-4, filed Nov. 9, 2015.

TECHNICAL FIELD

The present document relates to an active moisture control material. More particularly, the present disclosure relates to an active moisture control material for a packaging where the moisture level inside packaging (e.g. cigarette or dry food packaging) may be stabilized so that product inside will be stored at constant humidity before and after opening the package.

BACKGROUND

In many types of packages a barrier for moisture, aroma, oxygen etc. is needed to preserve the quality of the product which is contained in the package. Usually this barrier may be a so called a passive barrier, where there are separate barrier layers in the structure, in e.g. a cigarette package there is usually a plastic film wrapping combined with an aluminum foil or aluminum laminate structures. This means that existing packages are complex, having several material layers with separate barrier layer both outside and inside of the package.

After the opening of the package, it is a further challenge to keep the original, moisture level, or as close to the original as possible, inside the packaging. This is very critical for moisture sensitive products like cigarettes. The moisture level of cigarette should be around 10-15% during the whole package shelf life, and also after opening the package. In today's packages it is evident that moisture level of cigarette will change dramatically after first opening of the package because all the package barrier layers are destroyed, and the reclosing system is often not protecting enough. Average usage time for single cigarette package (20 cigarettes), after the first opening, is between one to five days and during that period moisture level inside the package and thus of the cigarette will change and that is not acceptable in quality wise.

Various solutions to be able to provide a more active moisture control have been suggested in the art. In for instance U.S. Pat. No. 4,997,082A a humidistat pad is included into the packaging.

In US2013292279A a cigarette package is disclosed in which a layer of a fibrous material having a moisture barrier layer embedded within the layer of the fibrous material or coated on the outside of the fibrous layer. The barrier layer comprises a polymer layer, which has limited capacity for absorbing moisture.

In WO09106493A1 a packaging with humidity control is disclosed, this packaging has a laminate structure, and a moisture-containing layer is interposed between two polymeric layers. The moisture-containing layer may be a paper saturated with water or aqueous salt solution, which can give control over the evaporation. The polymeric layers may be provided with tear-off strips to expose the moisture-containing layer inside the container, in order to hydrate the tobacco inside.

There is thus a need to for being able to produce a packaging which can actively control the humidity inside of the package which is further more easily manufactured or which does not require several layers or laminate structures.

SUMMARY

It is an object of the present disclosure, to provide an improved material for active moisture control, which eliminates or alleviates at least some of the disadvantages of the prior art materials.

More specific objects include providing a packaging formed from the moisture control material and methods for manufacturing the moisture control material.

The invention is defined by the appended independent claims. Embodiments and examples are set forth in the appended dependent claims and in the following description and drawings.

According to a first aspect there is provided an active moisture control material comprising a fiber based material and at least one active additive, wherein said active additive is adapted to control moisture transfer in the active moisture control material, and wherein said moisture control material is produced in a paper or board making process, wherein the active additive is incorporated into said active moisture control material.

By active moisture control material is meant an active material which can absorb moisture, such as water, from the environment, or prevent moisture for instance escaping a closed compartment, or even provide moisture, i.e. desorption of moisture, to the environment or the compartment it encloses or is adjacent to. This material is thus not a passive barrier material.

The active additive may thus be added for instance in the head box or in the stock solution, or through surface sizing or coating, such that the active additive is incorporated into the active moisture control material, i.e. into the fiber material, itself as in contrast to where a barrier material is formed by soaking a fiber material in a salt solution.

This material may thus form a base packaging material in itself, in contrast to having a separate moisture control or humidifier material in a packaging, such as for instance a cigarette box. This means that it may be easier to manufacture for instance a cigarette box, and also, after it has been opened it may be possible to have an improved control over the humidity inside the packaging.

The active additive may be incorporated during the production of said material in said paper or board making process or in a foam forming process.

This means that the material may be produced in any conventional paper or board making process. Foam forming may improve moisture controlling properties, in particular the moisture absorbance capacity of the material. In the alternative the active additive may be incorporated in a separate process step after board making process.

The active additive may be any one of sodium chloride, calcium chloride and potassium chloride, a sodium silicate, phosphates and a superabsorbent polymer or a mixture thereof. The superabsorbent polymer may be any one of a synthetic super absorbent polymer, a polysaccharide bases super absorbent polymer and a polyaminoacid based super absorbent polymer.

The fiber material may be any one of a paper, paper board, microfibrillated cellulose.

The material may have a thickness in the range of 20 μm to 3 mm, or in the range of 40 μm-1000μ, or in the range of 40 μm to 500 μm.

The thickness of the active moisture control material may thus be adapted to provide the required moisture balance or control of the moisture balance.

The active additive may be provided at well-defined areas of the fiber material, such that a moisture control pattern is provided.

The active moisture control material may further be provided with a passive moisture barrier material.

The passive moisture barrier layer may be laminated or coated onto the active moisture control material. It will create moisture barrier protection, and may control in which direction moisture can transfer and how fast the moisture can be transferred. The combination of both an active moisture barrier and a passive moisture barrier improves the control of the moisture level inside the package even further. The passive barrier may also further improve the protection of a packed product from outside conditions, such as a high or low humidity environment. The passive barrier material need only be applied on one side of the active control material, i.e. the side facing the outside environment of for instance a packaging. The other side may be arranged in direct contact with the packaged material, with no further need for coatings or barrier layers.

The passive barrier may comprise any one of a synthetic or renewable polymer.

The active moisture control material may be provided with a further paper or board layer, thereby forming a laminate structure.

The laminate structure may thus comprise the following structure board/passive barrier/moisture control material, or alternatively board/moisture control material, where the active control material is placed in connection with the inside of a package.

According to a second aspect there is provided a packaging formed from the active moisture control material according to the first aspect, thus forming an active moisture control packaging.

By active moisture control packaging is meant a packaging or a packaging material which is adapted for holding moisture sensitive materials therein. These types of packaging or packaging materials are used in for instance cigarette packages, or for various types of food.

This means that for instance a cigarette package or box can be formed by using the active moisture control material as a base packaging or and a blank for the entire package, and the active moisture control material is thus enclosing the cigarettes, i.e. the fiber material can be directly against the packed product. The active control material thus forms the main structure of the package. Conventional cigarette boxes comprise several separate layers to keep the moisture inside the package. With the active moisture control material the moisture may already be in the material, thus providing the required humidity for the packaged product, while still providing for an easy way of manufacturing the package.

The moisture control can thus be a fast process as there is no other barrier layer arranged on the inside of the packaging.

By using the active moisture control material to form the packaging there is not only provided a way of improving the control of the moisture inside the package, not only during storage and transpiration, but also when the package has been opened, but also a way of producing a moisture control packaging in an easy manner. The moisture level inside packaging can thus be stabilized (e.g. the cigarette or dry food packaging) so that product inside will be stored at constant humidity before, and after, opening the package.

The moisture control material can be tailored, with regards to the active additives and the thickness of the material, such that the packaging itself provides the required control if the speed and capacity of the absorption and/or desorption of moisture inside the packaging. This also means, that the need to introduce loose humidistat pad etc. for the moisture control is abolished.

The packaging may alternatively be provided with an outside passive barrier material, such as a plastic film or wrapping or an outside coating to keep moisture inside the whole package and to protect it from external condition changes.

The moisture control material may be pre-conditioned prior to the closing of the package.

By pre-conditioning is meant stabilizing the moisture content of the packaging material and also stabilizing the moisture content of the inside volume of the package to the right level. This means that once the material has been pre-conditioned, no other humidifying measures need to be taken to ensure correct environment for the packaged product. The pre-conditioning may take place just before closing the package, but may also be made in connection with the production of the moisture control material or a blank for forming the packaging.

The packaging may further be provided with, or comprise, a passive barrier layer.

The packaging may even further be provided with, or comprise, an outer paper or board layer.

The packaging thus forms a laminate structure, which may comprise the following structure board/passive barrier/moisture control material, or alternatively board/moisture control material, where the active control material is placed in connection with the inside of the packaging and the board or paper layer is on the outside, to provide improved structural stiffness to the packaging.

According to a third aspect there is provided the use of the packaging according to the second aspect, for packaging any one of cigarettes, medicaments, cosmetics, electronics, metal products, apparel, shoes and food.

The packaging may essentially be used for all types of moisture sensitive products. The packaging could for instance be used for packaging clothes (apparel) or shoes to avoid using or decreasing use of anti-mold additives.

According to a fourth aspect there is provided a method for manufacturing an active moisture control material in a paper or board making machine, wherein the active moisture control material comprises a fiber material and an active additive, wherein the method is any one of an online, inline or offline paper or board making operation, and wherein the method comprises the steps of providing a fiber material; and adding said active additive into said fiber material, thereby forming the active moisture control material.

The online paper or board making operation may comprises adding said active additive into said fiber material by any one of pulp mixture process, surface sizing process and coating process.

The offline paper or board making operation may comprise adding said active additive into said fiber material by any one of printing machine technology, coating technology, foam forming technology and impregnation technology.

The method may further comprise providing said active control material with a moisture control pattern at well-defined areas of the material.

By a moisture control pattern is meant that a well-defined area of the moisture control material is provided with the active additive, such that it is only this area or pattern that has the active moisture control properties. This may be done by printing process or slot die coating etc. such that the active additive is provided at the well-defined areas.

BRIEF DESCRIPTION OF THE DRAWINGS

The present solution will now be described, by way of example, with reference to the accompanying schematic drawing.

FIG. 1 illustrates a schematic perspective view of a packaging.

DETAILED DESCRIPTION

The invention relates to a fiber material into which an active component is added during the manufacturing process of the fiber material. The fiber material may be used for applications such as packaging.

The fiber material is, due to the addition of the active component or additive, able to pick up, and release, moisture. It is therefore an active moisture control material. By adding the active component or additive to or into the fiber material there is thus formed an active moisture control material.

The moisture absorption and/or desorption may be based mainly on fibers and the active additives may boosting the effect. The fiber material may thus create a high enough capacity for moisture control.

The fiber material may be any one of a paper, paper board, microfibrillated cellulose. The fiber material may essentially be any type of web type material, where fiber material is produced from non-fossile based raw materials, and which is used in conventional paper or board making processes. The fiber material may be any type of a cellulose based material. Preferably, the fiber material comprises cellulose fibers e.g. to an amount of at least 50 wt % calculated on the total solid content of the material, but it may comprise as much as at least 75 wt % or at least 80 wt % of cellulose fibers.

The active component or additive is thus adapted to control moisture transfer in the active moisture control material.

The active additive is preferably any one of sodium chloride, calcium chloride and potassium chloride. It may further be a sodium silicate, phosphates or a superabsorbent polymer or a mixture thereof. The sodium silicate may be for instance be $Na_2O_3Si$, known as liquid glass or water glass. The salt may have any suitable grade or form. The active additive may also be an additive essentially only capable absorbing moisture such as silica gel, bentonite clay, molecular sieve, calcium oxide or calcium sulfate.

The superabsorbent polymer (SAP) may be any one of a synthetic super absorbent polymer, a polysaccharide bases super absorbent polymer and a polyaminoacid based super absorbent polymer.

Examples of synthetic SAP may be those produced from acrylic monomers, such as acrylic acid (AA) or acryl amide (AM). One example of a synthetic SAP which can be added as an active additive is sodium polyacrylate.

Examples of polysaccaride based SAP are carboxymethylcellulose (CMC) and hydroxyethylcellulose (HEC). One example is sodium carboxymethylcellulose.

The active additive may also be a microfibrillated cellulose, which may have been modified.

The active component or additive may be added to or into the fiber material in paper/board machine directly, i.e. in an online process, or in an offline operation.

In the alternative the active additive may be incorporated in a separate process step after board making process Examples of an online operation may be for instance adding the active additive into the pulp mixture, either in a conventional way or through a so called in-line production process. The pulp mixture may, in addition to cellulose fibers from e.g. hardwood and/or softwood, further comprise fillers, retention agents, wet and/or dry strength additives, OBAs, and conventional wet-end chemicals well known to the skilled paper or paperboard maker. Online operation may further comprise any one of a size press or coating unit. The online operation may also comprise foam forming technologies. The foam forming may give a very thick structure of the material, which may enable a high capacity for moisture absorbance, especially compared to full plastic materials.

Examples of offline operation may be printing machine technology, coating technology, such as blade, rod, curtain, spray technologies, or impregnation, for instance through a size press.

The active control material may be used as a blank or base packaging material to for different types of packages.

In one examples, as shown by FIG. 1 the active control material may be used for a cigarette package 1. The package 1 has an inside 2, where the cigarettes (not shown) are placed and an outside 3.

The inside 2 may thus comprise the active control material 4. In one example the outside 3 comprises the active control material or alternatively an outside passive barrier material 5.

The passive barrier material 5 may be any one of a synthetic or renewable polymer. Examples of synthetic polymers may be any one of low density polyethylene (LDPE), high density polyethylene (HDPE), polypropylene (PP) and polyethylene terephthalate (PET). Examples of renewable polymeras may be so called green polyethylene (PE), green polyethylene terephthalate (PET), polylactic acid and polybutylene succinate (PBS). The passive barrier material may be applied onto the active control material during the manufacturing, for instance as a coating or film layer, or afterwards as a detachable film.

Examples of film application are film lamination, glue lamination, pressure sensitive lamination. The barrier layer may alternatively be applied through dispersion, water or solvent based coating systems. It may also be extrusion coated or extrusion laminated onto the active moisture control material.

The active moisture control material may have a thickness in the range of 20 μm to 3 mm, or in the range of 40 μm-1000μ, or in the range of 40 μm to 500 μm. The moisture absorption capacity will depend in the thickness and be higher with thicker material.

The packaging formed from the active moisture control material may be pre-conditioned prior to the closing of the package.

This pre-conditioning may take place during converting the blank into the packaging material or during filling of the packaging.

The packaging comprising the active control material may be used for all types of moisture sensitive products, such as cigarettes, medicaments, cosmetics, electronics, metal products, apparel, shoes and food.

The material or packaging may alternatively also be provided with a pattern, or a so called moisture absorption pattern. In some applications there might be a need to have moisture absorption properties only at certain areas of the packaging or packaging material. The pattern may be achieved by offline operations e.g. printing process or slot die coating etc. such that the active additive is provided at well-defined areas, or in a pattern of the fiber material. One of the advantages may be that there is less stiffness reduction due to absorbed moisture in the package.

In addition to providing the active moisture control material with a passive barrier, it may also be provide with a paper or board layer in a laminate structure, i.e. board/passive barrier/moisture control material. The active moisture control material would be inside the package. This would provide the advantage that stiffness to the package is generated mainly from outer board/paper layer which would not be absorbing moisture to any greater extent.

In view of the above detailed description of the present invention, other modifications and variations will become apparent to those skilled in the art. However, it should be apparent that such other modifications and variations may be effected without departing from the spirit and scope of the invention.

The invention claimed is:

1. An active moisture control material comprising a fiber based material and at least one active additive, wherein said active additive controls moisture transfer in the active moisture control material, and wherein the active moisture control material is produced in a paper or board making process wherein the active additive is incorporated into the active moisture control material, and wherein the active additive is any one of sodium chloride, calcium chloride and potassium chloride, a sodium silicate, phosphates, silica gel, bentonite clay, molecular sieve, calcium oxide, calcium sulfate, microfibrillated cellulose, a synthetic super absorbent polymer, a polysaccharide based super absorbent polymer, or a polyaminoacid based super absorbent polymer;

a passive barrier material laminated or coated onto the active moisture control material, wherein the passive barrier material comprises a synthetic polymer or a renewable polymer; and a paper or board layer on the passive barrier material.

2. The active moisture control material as claimed in claim 1 wherein the active additive is incorporated during the production of the active moisture control material in said paper or board making process.

3. The active moisture control material as claimed in claim 1, wherein said fiber based material is any one of a paper, paper board, or microfibrillated cellulose.

4. The active moisture control material as claimed in claim 1, wherein the active moisture control material has a thickness in the range of 20 μm to 3 mm.

5. The active moisture control material as claimed in claim 1, wherein the active additive is provided at well-defined areas of the fiber based material, such that a moisture control pattern is provided.

6. The active moisture control material as claimed in claim 1 wherein the active additive is incorporated during the production of the active moisture control material in a foam forming process.

7. The active moisture control material as claimed in claim 1, wherein the active moisture control material has a thickness in the range of 40 μm-1000 μm.

8. The active moisture control material as claimed in claim 1, wherein the active moisture control material has a thickness in the range of 40 μm to 500 μm.

9. The active moisture control material as claimed in claim 1, wherein the active additive is microfibrillated cellulose.

10. The active moisture control material as claimed in claim 1, wherein the active additive is a polyaminoacid based super absorbent polymer.

11. The active moisture control material as claimed in claim 1, wherein the active additive is added to the fiber based material by mixing the active additive with fibers.

12. The active moisture control material as claimed in claim 1, wherein the active additive is added to the fiber based material by surface sizing or coating the active additive on the fiber based material.

13. The active moisture control material as claimed in claim 1, wherein the fiber based material comprises at least 50 wt% cellulose fibers.

14. The active moisture control material as claimed in claim 1, wherein the passive barrier material comprises any one of low density polyethylene (LDPE), high density polyethylene (HDPE), polypropylene (PP), polyethylene terephthalate (PET), polylactic acid, and polybutylene succinate (PBS).

* * * * *